United States Patent [19]

Yokoyama et al.

[11] Patent Number: 4,791,423

[45] Date of Patent: Dec. 13, 1988

[54] SHORTED MICROSTRIP ANTENNA WITH MULTIPLE GROUND PLANES

[75] Inventors: Yukio Yokoyama, Tokyo; Yoshio Ebine, Kanagawa; Toshio Ito, Tokyo, all of Japan

[73] Assignees: NEC Corporation; Nippon Telegraph & Telephone Corp., both of Japan

[21] Appl. No.: 937,495

[22] Filed: Dec. 3, 1986

[30] Foreign Application Priority Data

Dec. 3, 1985 [JP] Japan ..... 60-271979
Dec. 3, 1985 [JP] Japan ..... 60-271980

[51] Int. Cl.[4] ..... H01Q 1/38
[52] U.S. Cl. ..... 343/700 MS; 343/702
[58] Field of Search ..... 343/700 MS, 702

[56] References Cited

U.S. PATENT DOCUMENTS 4,386,357 5/1983 Patton ..... 343/700 MS
4,410,891 10/1983 Schaubert et al. ..... 343/700 MS
4,575,725 3/1986 Tresselt ..... 343/700 MS
4,644,361 2/1987 Yokoyama ..... 343/700 MS

FOREIGN PATENT DOCUMENTS 0174068 3/1986 European Pat. Off. ..... 343/700 MS
0041205 2/1986 Japan .

*Primary Examiner*—William L. Sikes
*Assistant Examiner*—Doris J. Johnson
*Attorney, Agent, or Firm*—Ostrolenk, Faber, Gerb & Soffen

[57] ABSTRACT

A low and broadband shorted microstrip antenna is disclosed which is mainly applicable to a mobile body in a mobile communication system. A first grounding conductive sheet which faces a radiating conductive sheet is provided at both ends thereof with a second and a third grounding conductive sheets which are perpendicular to the first grounding conductive sheet, whereby a beam tilt characteristic of the antenna is improved. The passive element and a conductive stub are disposed atop the grounding conductive sheet. The passive element and the conductive stub face the radiating conductive element and serve to improve the impedance matching parameter of the microstrip antenna.

11 Claims, 7 Drawing Sheets

SHORTED MICROSTRIP ANTENNA WITH MULTIPLE GROUND PLANES

BACKGROUND OF THE INVENTION

The present invention relates to a low and broad bandwidth shorted microstrip antenna which is shorted at one side thereof and may be mounted on a mobile body in a mobile communication system and provided with improved beam tilting and impedance matching characteristics.

A shorted microwave strip antenna (SMSA) is a half-sized version of an ordinary patch antenna and is characterized by a miniature, light weight and low height costruction. Due to such advantages, an SMSA is suitable for use as an antenna which is mounted on a mobile body in a mobile communication system. Generally, an SMSA includes a grounding conductive sheet on which a feed connector is mounted, a radiating conductive sheet which faces the grounding conductive sheet with the intermediary of air or like dielectric material, and a connecting conductive sheet positioned at the shorted end of those two conductive sheets perpendicular to the surfaces of the latter in order to connect them together.

In the above-described type of SMSA, assume X and Y axes in a general plane of the emitting and the grounding conductive sheets (the Y axis extending along the general plane of the connecting conductive sheet), and a Z axis in the general plane of the connecting conductive sheet which is perpendicular to the X and Y axes. Then, emission occurs in the SMSA due to a wave source which is developed in the vicinity of a particular side of the radiating conductive sheet which is parallel to the Y axis and not shorted. If the size of the grounding conductive sheet is effectively infinite, the SMSA is non-directional in the X-Z plane on condition that Z is greater than zero; if it is finite, the SMSA obtains the maximum directivity in the vicinity of the Z axis. When the radiating conductive sheet is positioned at, for example, substantially the center of the grounding conductive sheet, the directivity is such that the maximum emission direction is tilted from the Z direction, resulting in a decrease in the gain in the Z direction. This is accounted for by the fact that the wave source of the SMSA is not located at the center of the grounding conductive sheet. A prior art implementation to eliminate such beam tilts consists in dimensioning the grounding conductive sheet substantially twice as long as the radiating conductive sheet in the X direction. This kind of scheme, however, prevents the SMSA from being reduced in size noticeably, compared to an ordinary microstrip antenna (MSA). It therefore often occurs that it is difficult for an SMSA to be installed in a mobile body such as an automotive vehicle.

Further, as regards an SMSA having a relatively small connecting conductive sheet, current is allowed to flow into the jacket of a cable which is joined to a feed connector. This would render the impedance matching characteristic of the antenna unstable and disturb the directivity.

SUMMARY OF THE INVENTION

It is therefore an object of the present invention to provide an SMSA which is small in size and stable in directivity.

It is another object of the present invention to provide an SMSA which has improved beam tilting and impedance matching characteristics.

It is another object of the present invention to provide a generally improved SMSA.

A microstrip antenna shorted at one side thereof of the present invention comprises a generally rectangular radiating conductive sheet for supplying power to be radiated, a first grounding conductive sheet located to face and extend parallel to the radiating conductive sheet, a generally rectangular second grounding conductive sheet located at one side of and extending perpendicular to the first grounding conductive sheet and connected to the radiating conductive sheet, and a third grounding conductive sheet located to face and extended parallel to the second grounding conductive sheet and provided at one side of and perpendicular to the first grounding conductive sheet which opposes the one side.

The above and other objects, features and advantages of the present invention will become more apparent from the following detailed description taken with the accompanying drawings.

DESCRIPTION OF THE PREFERRED EMBODIMENTS

Figure 1A:
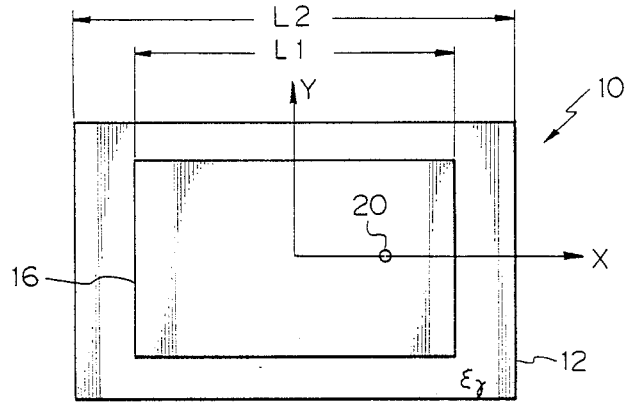
Fig. 1A PRIOR ART
FIGS. 1A and 1B are a plan view and a side elevation, respectively, of a prior art ordinary MSA.
Figure 1B:
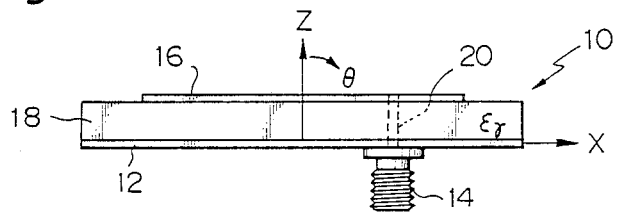
Fig. 1B PRIOR ART
Figure 1C:
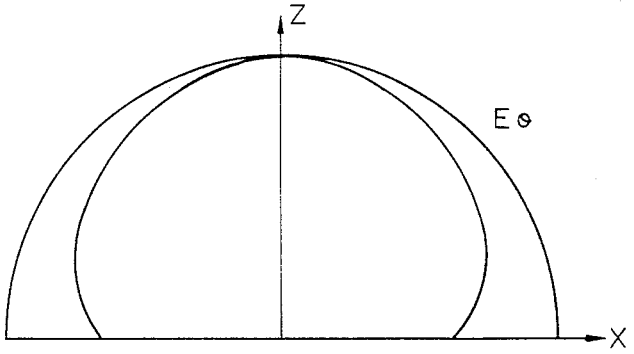
Fig. 1C PRIOR ART

To facilitate an understanding of the present invention, brief reference will be made to a prior art MSA and to a prior art SMSA, as shown in FIGS. 1A, 1B and 2.

Referring to FIGS. 1A and 1B, a prior art ordinary MSA 10 includes a grounding conductive sheet 12 on which a feed connector 14 is mounted, and a radiating conductive sheet 16 located to face the sheet 12 and separated therefrom by an intermediary of air or like dielectric material 18. Reference numeral 20 designates a feed pin. Assuming that the length of the conductive sheet 16 along an X axis is $L_1$, it may be said that $L_1=\lambda/2\sqrt{\epsilon}$, where $\lambda o$ is the free space wavelength at a frequency used and $\epsilon\gamma$ the specific relative dielectric constant of the dielectric 18. The grounding sheet 12 is assumed to have a length $L_2$ in the X direction. In this type of MSA 10, emission is developed by a radiating source which is produced in the vicinity of two sides of the conductive plate 16 which are parallel to a Y axis. The emission is such that the maximum emission direction occurs along a Z axis.

Figure 2A:
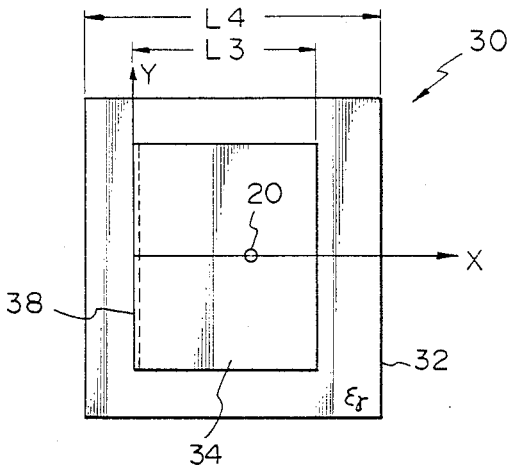
Fig. 2A PRIOR ART
FIGS. 2A and 2B are a schematic plan view and a side elevation, respectively, of a prior art SMSA.
Figure 2B:
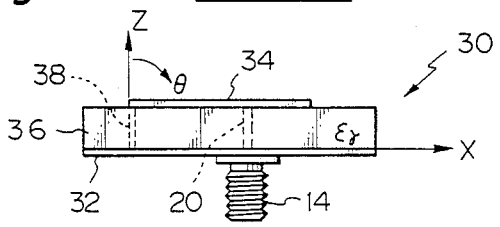
Fig. 2B PRIOR ART

FIGS. 2A and 2B show a prior art SMSA 30 consisting of a grounding conductive sheet 32 carrying the feed connector 14 therewith, a radiating conductive sheet 34 located to face the sheet 32 with the intermediary of air or like conductive material 36, and a connecting conductive sheet 38 located at the shorted end of the sheets 32 and 34 and extending perpendicularly to connect them together. Assuming that the length of the radiating sheet 34 in the X direction is $L_3$, it follows that $L_3=\lambda o/4\sqrt{\epsilon\gamma}$, where $\lambda o$ the free space wavelength at a frequency used and $\epsilon\gamma$, the specific relative dielectric constant of the dielectric 36. The length of the conductive sheet 32 in the X direction is assumed to be $L_4$. It will be understood that the length of the SMSA 30 is half the MSA 10 in terms of the length of the radiating conductive sheet, such that the entire antenna has considerably smaller dimensions. Such an antenna is desirably applicable to a mobile body of a mobile communication system.

Figure 2C:
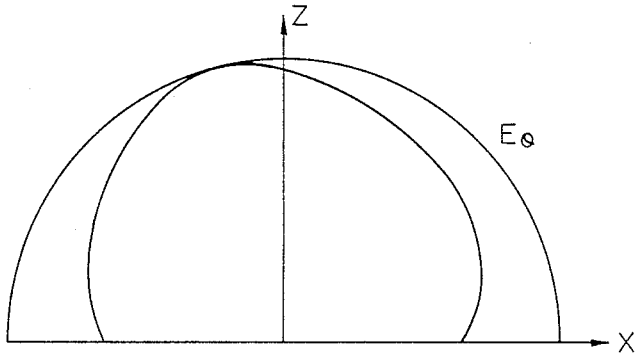
Fig. 2C PRIOR ART
FIG. 2C is a chart similar to FIG. 1, showing the directivity of the MSA of FIGS. 2A and 2B.

In the SMSA 30, emission occurs due to a radiating source which is developed in the vicinity of that side of the radiating conductive sheet 34 which is parallel to the Y axis and not shorted. If the size of the grounding conductive sheet 32 is infinite, the SMSA 30 is nondirectional in the X-Z plane on condition that Z is greater than zero; if it is finite, the SMSA 30 has maximum directivity in the vicinity of the X axis. When the radiating conductive sheet 34 is positioned at, for example, substantially the center of the grounding conductive sheet 32, the directivity is such that, as shown in FIG. 2C, the maximum emission direction is tilted from the Z direction, resulting in a decrease in the gain in the Z direction. This is accounted for by the fact that the wave source of the SMSA 30 is not located at the center of the grounding conductive sheet 32. A prior art implementation to eliminate such beam tilts consists in dimensioning the grounding conductive sheet 32 of FIGS. 2A and 2B substantially twice as long as the radiating conductive plate 34 in the X direction, i.e. $L_4 \approx 2 \times L_3$.

As previously discussed, the problem with the prior art SMSA 30 is that the radiating conductive plate 34 inclusive of the grounding conductive sheet is not noticeably smaller than that of the MSA 10 of FIGS. 1A and 1B, although halved in size. Such often makes it difficult for the antenna to be built in an automotive vehicle and other mobile bodies.

Figure 3A:
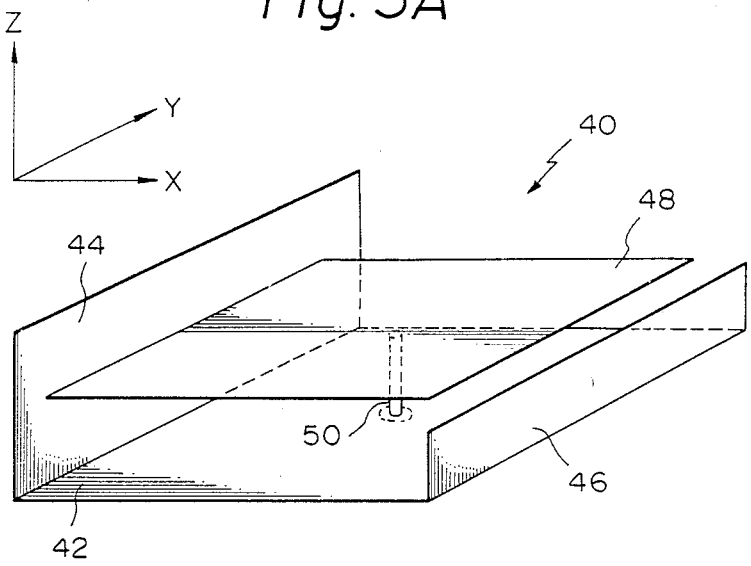
FIG. 3A is a perspective view of an SMSA embodying the present invention.
Figure 3B:
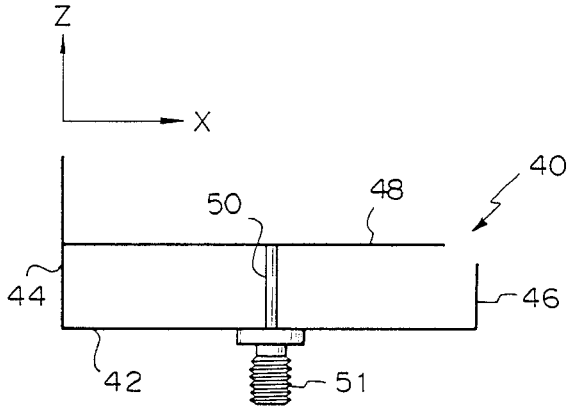
FIG. 3B is a side elevation of the SMSA as shown in FIG. 3A.

Referring now to FIGS. 3A and 3B, an SMSA embodying the present invention is shown and generally designated by the reference numeral 40. As shown, the SMSA 40 comprises a first grounding conductive sheet 42, a second and a third grounding conductive sheets 44 and 46 which are mounted on the conductive sheet 42 perpencidularly thereto, a radiating conductive sheet 48 connected to the conductive sheet 4, a feed pin 50, and a feed connector 51. The second grounding conductive sheet 44 functions as a connecting conductive sheet which connects the first grounding conductive sheet 42 and the radiating conductive sheet 48 to each other. The SMSA 40 shows the maximum directivity in the Z direction if the dimensions of the second and third grounding conductive sheets 44 and 46 are selected appropriately. The SMSA 40 which uses the second and third grounding conductive plates is greater than the prior art SMSA 30 with respect to the area of the entire grounding conductive plate. This allows a minimum of current to flow into the jacket of a feed cable which is connected to the feed connector 51, thereby freeing the impedance and directivity from being substantially influenced by feed cable.

As described above, in accordance with this particular embodiment, a miniature antenna with a minimum beam tilt in the Z direction is attained by virtue of a second and a third grounding conductive sheets which are located at both ends of and perpendicularly to a first grounding conductive sheet, which faces the radiating conductive sheet.

Further, the antenna of this embodiment reduces current which flows into the jacket of a feed cable, compared to a prior art SMSA, whereby the impedance characteristic and the directivity are negligebly susceptible to the influence of the feed cable and provide, therefore, stable operation.

Figure 4:
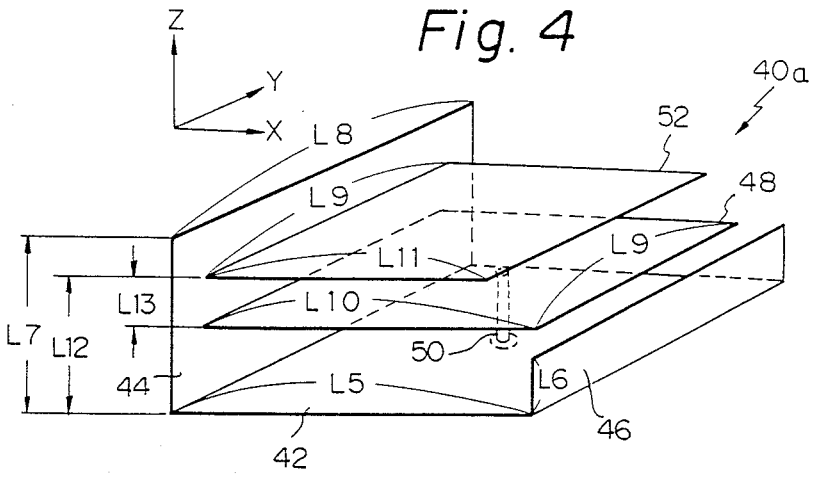
FIG. 4 is a perspective view of another embodiment of the present invention.

FIG. 4 illustrates an SMSA **40*a* which is provided with a passive element 52, having a broader bandwidth than the SMSA 40 of FIGS. 3A and 3B. Specifically, the SMSA 40*a* is provided with a several times broader bandwidth than the SMSA 40 by adequately selecting the dimensions of the passive element 52, the distance between the passive element 52 and the radiating conducitive sheet 48, and the distance between the passive element 52 and the grounding conductive sheet 42**.

Figure 5:
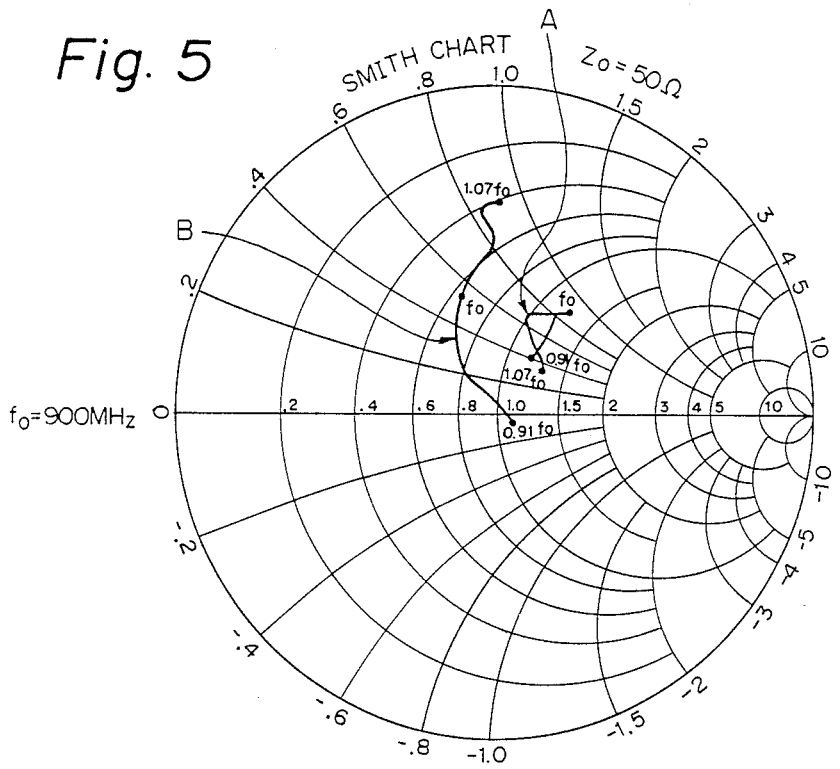
FIG. 5 is a Smith chart comparing the embodiment of FIGS. 3A and 3B and that of FIG. 4 in terms of values of impedance characteritic actually measured.

In FIG. 5, the SMSA **40*a* having the passive element 52 located close to the radiating conductive sheet 48 as shown in FIG. 4 and the SMSA 40 without a passive element as shown in FIGS. 3A and 3B are compared in terms of actually measured impedance values. The curve A is representative of the impedance characteristic of the SMSA 40*a* and a curve B of SMSA 40. The curves A and B were attained by setting up a center frequency $f_0$ of 900 MHz. Further, assuming that the lengths of the SMSA 40*a* are $L_5$ to $L_{13}$ as indicated in FIG. 4**, then $L_5=92$ mm, $L_6=16$ mm, $L_7=50$ mm, $L_8=105$ mm, $L_9=85$ mm, $L_{10}=76$ mm, $L_{11}=67$ mm, $L_{12}=28$ mm, and $L_{13}=8$ mm.

As described above, an SMSA with a passive element achieves a comparatively constant impedance characteristic by virtue of the effect of the passive element. However, the impedance of such an SMSA involves a part which is derived from a reactance and cannot be matched to a 50-ohm system. Another drawback to this antenna is that the matching characteristics cannot be improved even if the feed position is changed.

Figure 6A:
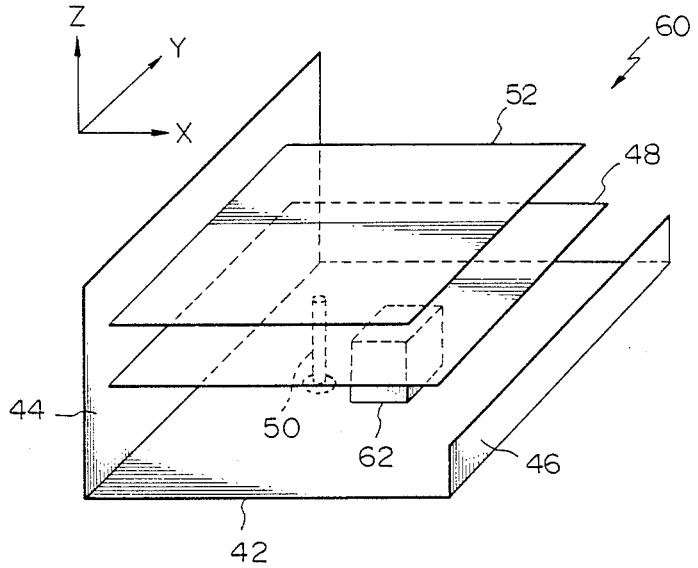
FIGS. 6A and 6B are a perspective view and a side elevation, respectively, of still another embodiment of the present invention.
Figure 6B:
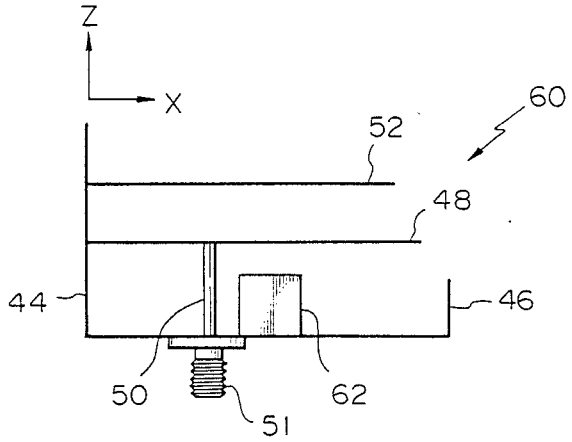

Referring to FIGS. 6A and 6B, another embodiment of the present invention is shown which is provided with an improved impedance matching characteristic. In FIGS. 6A and 6B, the same or similar structural elements as those shown in FIG. 4 are designated by like reference numerals. As shown, the SMSA 60 comprises a conductive stub 62 in addition to the grounding conductive sheet 42, radiating conductive sheet 48, passive element 52, connecting conductor 44, and feed pin 50. The SMSA 60 can serve as a broad bandwidth antenna which well matches itself to a 50-ohm system, but only if the dimensions and position of the conductive stub 62 are selected adequately.

Figure 7:
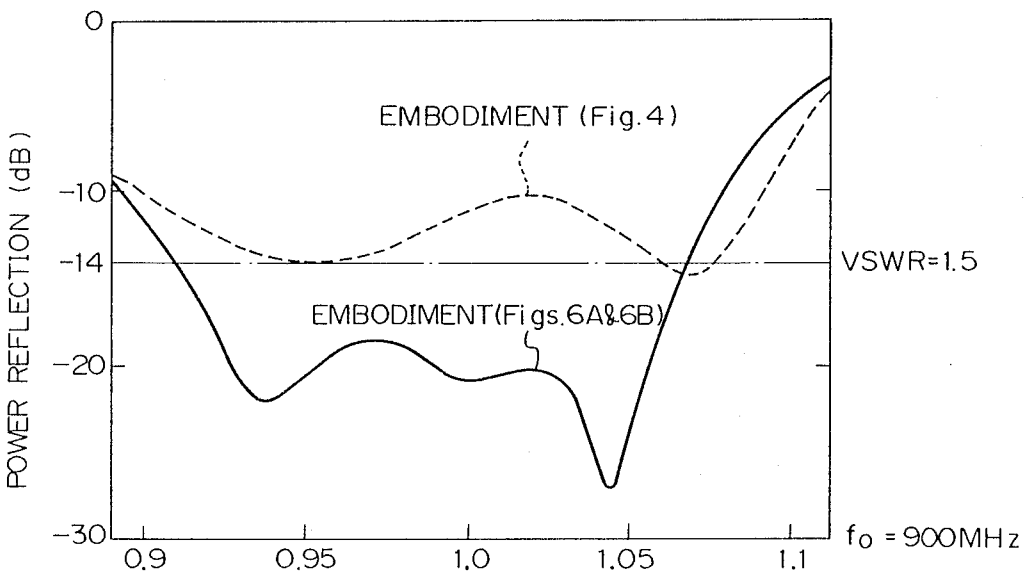
FIG. 7 is a plot comparing the embodiment of FIG. 4 and that of FIGS. 6A and 6B in terms of a reflection loss characteristic.

FIG. 7 shows a reflection loss characteristic of the SMSA 60 of FIGS. 6A and 6B as represented by a solid curve and that of the SMSA **40*a* of FIG. 4 with a passive element as represented by a dotted curve. The solid and the dotted curves were attained with the same center frequency and the same dimensions as those previously described. As shown, hardly any power reflection less than −14 dB (VSWR=1.5) is attained by the SMSA 40***a*. In contrast, the SMSA 60 of this embodiment maintains power reflection which is less than −14 dB over a very broad bandwidth, i.e. 16%. Thus, the embodiment of FIGS. 6A and 6B realizes an antenna which shows good matching to a 50-ohm system. Specifically, because the conductive stub 62 serves as an impedance compensating element which shows a constant reactance characteristic over a broad bandwidth, that part of the impedance which is derived from reactance can be compensated for without disturbing the constant impedance characteristic which is ensured by the passive element 52.

It is to be noted that although the conductive stub 62 is shown as having a rectangular parallelepiped configuration, it may be provided with any other configuration such as a cylindrical one without affecting the characteristic.

As described above, this particular embodiment provides an SMSA with a passive element which is provided with a conductive stub on a grounding conductive sheet which faces a radiating conductive sheet, so that its matching with a feed line of an SMSA with a passing element which shows a constant impedance is improved. The SMSA, therefore, functions as a broad bandwidth antenna having a physically low structure.

Figure 8:
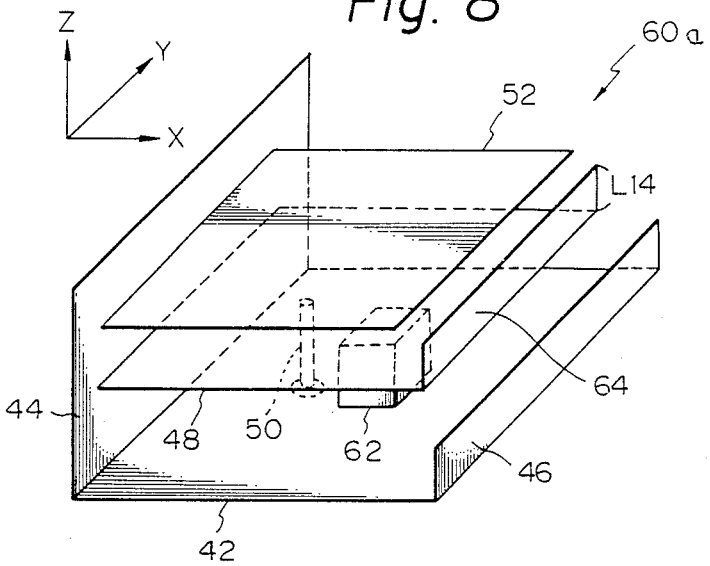
FIG. 8 is a perspective view of a modification to the embodiment of FIGS. 6A and 6B.

Referring to FIG. 8, a modified embodiment of the SMSA 60 of FIGS. 6A and 6B, generally 60*a*, is shown which is provided with an additional conductive sheet 64 which is mounted on the radiating conductive sheet 48 perpendicular thereto and has a length $L_{14}$. The sheet 64 functions to lower the resonance frequency.

Figure 9:
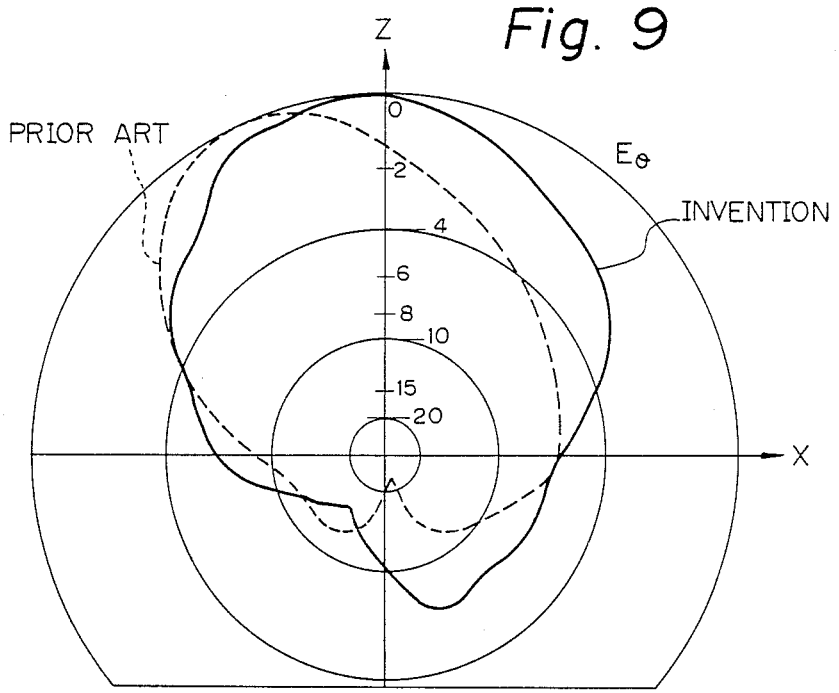
FIG. 9 is a chart showing the directivity of the SMSA of FIG. 8 together with that of the prior art SMSA for comparison.

Referring to FIG. 9, there is shown a chart for comparing the modified SMSA 60*a* of FIG. 8 and the prior art SMSA 30 of FIGS. 2A and 2B in terms of data actually measured on the directivity in the X-Z plane. In FIG. 9, the solid line is representative of the modified SMSA 60*a* of the present invention and the dotted line, of the prior art SMSA 30. Specifically, while the data associated with the prior art SMSA 30 were measured under the conditions of $\epsilon\gamma=1$, $L_3=75$ mm, and $L_4=200$ mm, the data associated with the SMSA 60*a* of the present invention were measured on the conditions of $\epsilon\gamma=1$ and $L_{14}=7$ mm. The other dimensions such as $L_5$ to $L_{13}$ were the same as those of the SMSA 40*a* SMSA 40*a* of FIG. 4.

It wil

It will be seen from the above that the SMSA 60*a* in accordance with this modification achieves an improved beam tile characteristic in the Z direction. This leads to an improvement in the gain in the Z direction by 1.0 to 1.5 dB.

Various embodiments will become possible for those skilled in the art after receiving the teachings of the present disclosure without ddeparting from the scope thereof.

What is claimed is:

1. A shorted microstrip antenna, comprising:

a generally rectangular radiating conductive sheet for supplying power to be radiated;

a first grounding conductive sheet spaced from, facing and extending generally parallel to said radiating conductive sheet;

a second grounding conductive sheet in contact with and extending perpendicularly to said first grounding conductive sheet, said radiating conductive sheet being connected to said second grounding conductive sheet; and a third grounding conductive sheet in contact with and extending generally perpendicularly to said first grounding conductive sheet, said third grounding conductive sheet being spaced from and extending generally parallel to said second grounding conductive sheet.

2. A shorted microstrip antenna as in claim 1, further comprising a planar passive element extending generally in parallel to said radiating conductive sheet and connected to said second grounding conductive sheet at a location thereof such that said radiating conductive sheet is disposed between said first grounding conductive sheet and said planar passive element.

3. A shorted microstrip antenna as in claim 1, wherein said second grounding conductive sheet is generally rectangular and planar.

4. A shorted microstrip antenna as in claim 3, wherein said third grounding conductive sheet is generally rectangular and planar.

5. A shorted microstrip antenna as in claim 4, wherein said radiating conductive sheet extends toward but does not reach the plane containing said third grounding conductive sheet.

6. A shorted microstrip antenna as in claim 5, wherein said passive element extends toward but does not reach said plane containing said third grounding conductive sheet.

7. A shorted microstrip antenna as in claim 1, including a further conductive sheet located at a side edge of said radiating conductive sheet which side edge is juxtaposed to that side edge of said radiating conductive sheet which is connected to said second grounding conductive sheet, said further conductive sheet extending generally parallel to said second grounding conductive sheet.

8. A shorted microstrip antenna as in claim 2, wherein the dimension of the passive element as measured from the second to the third grounding conductive sheet is smaller than the corresponding dimension of the radiating conductive sheet.

9. A shorted microstrip antenna as claimed in claim 2, further comprising a conductive stub member connected to said first grounding conductive sheet and projecting toward said radiating conductive sheet.

10. A shorted microstrip antenna as claimed in claim 9, wherein said conductive stub member has a rectangular parallelepiped configuration.

11. A shorted antenna as claimed in claim 9, wherein said conductive stub member has a cylindrical configuration.

* * * * *